US005432498A

United States Patent [19]

Zilbershtein et al.

[11] Patent Number: 5,432,498

[45] Date of Patent: Jul. 11, 1995

[54] SENSING CABLE

[75] Inventors: Moshe Zilbershtein, Rishon Lezion; Zvi Dank, Herzliya, both of Israel

[73] Assignee: Magal Security Systems, Ltd., Yahud, Israel

[21] Appl. No.: 154,780

[22] Filed: Nov. 18, 1993

[51] Int. Cl.[6] ..... G08B 13/00

[52] U.S. Cl. ..... 340/566; 340/541; 340/565

[58] Field of Search ..... 340/561, 541, 564, 565, 340/566

[56] References Cited

U.S. PATENT DOCUMENTS

| | | | |
|---|---|---|---|
| 3,831,162 | 8/1974 | Armstrong | 340/525 |
| 3,836,899 | 9/1974 | Duvall et al. | 340/566 |
| 3,925,593 | 12/1975 | Kardashian | 380/541 |
| 4,097,025 | 6/1978 | Dettmann et al. | 340/566 |
| 4,107,660 | 8/1978 | Chleboun | 340/566 |
| 4,186,325 | 1/1980 | Gudzin | 340/565 |
| 4,356,423 | 10/1982 | Gudzin | 340/566 |
| 4,374,378 | 2/1983 | Lee | 340/566 |
| 4,777,476 | 5/1989 | Dank | 340/541 |
| 4,829,286 | 5/1989 | Dank | 340/541 |
| 5,268,672 | 12/1993 | Kerr | 340/565 |

*Primary Examiner*—John K. Peng
*Assistant Examiner*—Benjamin Lee
*Attorney, Agent, or Firm*—Harold Levine

[57] ABSTRACT

A sensing cable element including a non-uniform cable which is configured so as to substantially vary along its length in its ability to detect mechanical disturbances.

53 Claims, 4 Drawing Sheets

SENSING CABLE

FIELD OF THE INVENTION

The present invention relates to indoor and outdoor intruder detection systems.

BACKGROUND OF THE INVENTION

A variety of intruder detection systems are currently available. In some intruder detection systems, known as "pinpoint" systems, a plurality of detection boxes ("pinpoints") are spaced along a fence or other element to be monitored. Each pair of adjacent detection boxes is intended to monitor the area between them. These systems are relatively cumbersome and expensive and are not unobtrusive since the detection boxes are clearly visible.

One such system is marketed by R. B. Tec, Ltd., P. 0. B. 47117, Ramat Hasharon, Israel.

A more desirable category of intruder detection systems is the category of mechanical disturbance detecting cable systems in which the intruder detection function is performed by a sensing cable disposed along the fence or element to be monitored. The sensing cable typically engages the fence at a plurality of locations.

The sensing cable in these systems typically includes a piezo-electric or magnetic or microphonic cable which is operative to generate an electric signal in response to mechanical disturbances within a sensing radius characterizing the sensing cable. This electrical signal serves as a warning of the presence of an intruder.

SUMMARY OF THE INVENTION

A disadvantage of mechanical disturbance detecting cable systems is a relatively high false alarm rate which is not compensated by a concurrently high detection rate. This is because, in conventional systems, the entire length of the sensing cable is active to detect intruders or, more generally, mechanical disturbances, whereas only the fence-engaging portions of the sensing cable contribute significantly to the detection rate. The portions of the sensing cable which do not engage the fence are not significantly effective in detection of mechanical disturbances to the fence but do tend to detect "false alarm" mechanical disturbances such as precipitation falling upon the non-engaging portions.

In other words, the portions of the sensing cable which do not engage the fence, which normally make up the majority of the length of the cable, substantially increase the false alarm rate of the system without substantially increasing the detection rate thereof.

Another disadvantage of conventional mechanical disturbance detection cable systems is their relatively high cost per unit length since piezo-electric, magnetic and microphonic cables are relatively expensive.

The present invention seeks to provide an improved sensing cable element and an improved mechanical disturbance detection system based on the improved sensing cable element.

The present invention is described as a piezoelectric cable based intruder detection system. However, it is appreciated that the applicability of the apparatus and methods shown and described herein are not limited to intruder detection and are applicable for detecting a wide variety of mechanical disturbances. It is also appreciated that the apparatus and methods shown and described herein need not be based on piezoelectric cable and may alternatively be based on any other type of mechanical disturbance sensing cable such as magnetic or microphonic cable.

There is thus provided, in accordance with a preferred embodiment of the present invention, a sensing cable element including a non-uniform cable which is configured so as to substantially vary along its length in its ability to detect mechanical disturbances. There is also provided, in accordance with another preferred embodiment of the present invention, a mechanical disturbance detection system including a non-uniform sensing cable which is configured so as to substantially vary along its length in its ability to detect mechanical disturbances, and at least one cable attacher for attaching the non-uniform sensing cable to an object to be monitored.

There is also provided, in accordance with a further preferred embodiment of the present invention, a method for manufacturing a mechanical disturbance detecting system including the step of non-uniformly processing a sensing cable element such that the processed sensing cable element substantially varies along its length in its ability to detect mechanical disturbances. There is also provided, in accordance with yet a further preferred embodiment of the present invention, a method for detecting mechanical disturbances including the steps of attaching a mechanical disturbance sensing cable element to an object to be monitored at a plurality of attachment locations, and employing the sensing cable element to provide warnings of mechanical disturbances, wherein the sensing cable element substantially varies along its length in its ability to detect mechanical disturbances.

Further in accordance with a preferred embodiment of the present invention, the non-uniform cable includes a plurality of cable portions, wherein the mechanical disturbance detection capability of some of the plurality of cable portions is substantially greater than the capability in others of the plurality of cable portions.

Still further in accordance with a preferred embodiment of the present invention, high mechanical disturbance detection capability cable portions are interspersed with low mechanical disturbance detection capability cable portions and the distance between adjacent high mechanical disturbance detection capability cable portions does not exceed the sensing radius of each.

Additionally in accordance with a preferred embodiment of the present invention, the distance between adjacent high capability cable portions is less than the sensing radius of each.

Further in accordance with a preferred embodiment of the present invention, the detection capability of the low capability cable portions is effectively zero.

Still further in accordance with a preferred embodiment of the present invention, each cable portion includes a cable segment and a plurality of segment couplers for coupling adjacent cable segments.

Additionally in accordance with a preferred embodiment of the present invention, each high capability cable segment is approximately 20 centimeters long and each low capability cable segment is approximately 2 meters long.

Still further in accordance with a preferred embodiment of the present invention, at least the high capability portions of the cable are formed of an individual one of the following: piezoelectric cable, magnetic cable, and microphonic cable.

Further in accordance with a preferred embodiment of the present invention, the low capability portions of the cable include coax cable.

Still further in accordance with a preferred embodiment of the present invention, the system includes an object to be monitored, such as a fence, to which the sensing cable element is attached at a plurality of attachment locations.

Further in accordance with a preferred embodiment of the present invention, the sensing cable element is attached to the object to be monitored such that high mechanical disturbance detection capability portions of the sensing cable element are relatively inaccessible to precipitation.

Still further in accordance with a preferred embodiment of the present invention, the high detection capability portions are oriented generally vertically.

Additionally in accordance with a preferred embodiment of the present invention, the high detection capability portions are arranged generally below low mechanical disturbance detection capability portions of the sensing cable element.

Further in accordance with a preferred embodiment of the present invention, the sensing cable element is attached to the object to be monitored such that substantially all of the high capability portions are disposed adjacent a corresponding one of the plurality of attachment locations.

Still further in accordance with a preferred embodiment of the present invention, substantially all of the high capability portions are centered at a corresponding one of the plurality of attachment locations.

Additionally in accordance with a preferred embodiment of the present invention, each cable portion includes a cable segment and the method of manufacture also includes the step of providing a plurality of segment couplers for coupling adjacent cable segments.

Still further in accordance with a preferred embodiment of the present invention, each cable portion includes a cable segment and the method for detecting also includes the step of providing a plurality of segment couplers for coupling adjacent cable segments.

Still further in accordance with a preferred embodiment of the present invention, the method for detecting includes the step of providing an object to be monitored to which the sensing cable element is attached at a plurality of attachment locations.

Further in accordance with a preferred embodiment of the present invention, the object to be monitored includes a fence.

Still further in accordance with a preferred embodiment of the present invention, the method for detecting includes the step of attaching the sensing cable element to the object to be monitored such that high mechanical disturbance detection capability portions of the sensing cable element are relatively inaccessible to precipitation.

Additionally in accordance with a preferred embodiment of the present invention, the method for detecting also includes the step of attaching the processed sensing cable element to an object to be monitored.

BRIEF DESCRIPTION OF THE DRAWINGS

The present invention will be understood and appreciated from the following detailed description, taken in conjunction with the drawings in which.

DETAILED DESCRIPTION OF PREFERRED EMBODIMENTS

Figure 1:
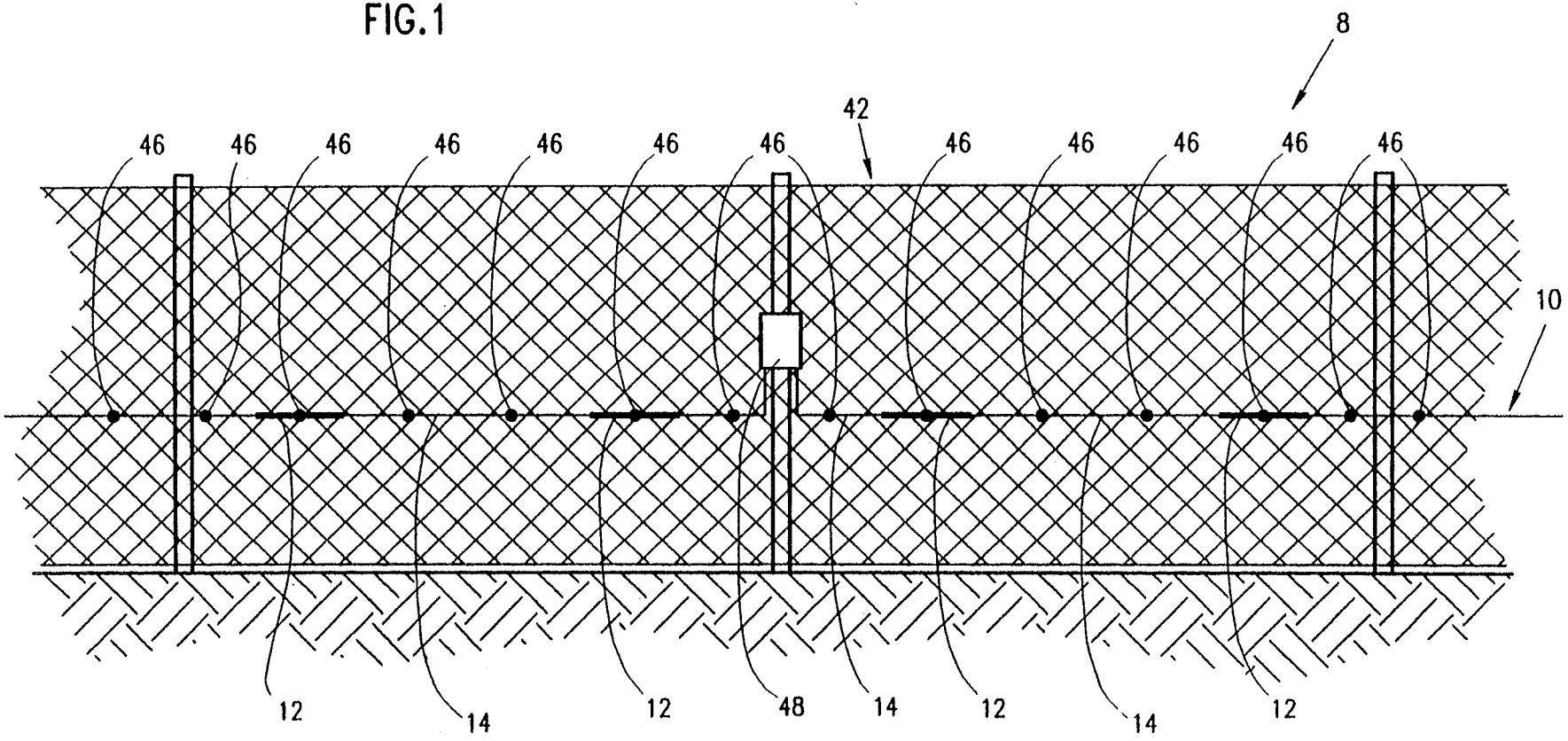
FIG. 1 is a pictorial front view illustration of a mechanical disturbance sensing system constructed and operative in accordance with a preferred embodiment of the present invention.

Reference is now made to FIG. 1 which illustrates a mechanical disturbance detection system, referenced generally 8, which includes a sensing cable element, referenced generally 10, operative to sense mechanical disturbances such as tampering or a penetration attempt by a human intruder.

A particular feature of sensing cable element 10 is that its mechanical disturbance detection capability substantially varies along its length. Preferably, high detection capability is provided only in some or all of the locations along the sensing cable element which are intended to engage the object to be monitored. Zero or low detection capability is provided in the remaining locations which are not intended to engage the object to be monitored.

For example, the high detection capability portions of sensing cable element 10 may include a plurality of high detection capability portions 12 such as segments of piezoelectric cable. The high detection capability portions 12 may be interspersed with a plurality of low detection capability portions 14 such as segments of coax cable. A suitable coax cable is, for example, an RG-58 cable, commercially available from Belden Incorporated, POB 1980, Richmond, Ind., 47375, USA.

A suitable piezoelectric cable is described below with reference to FIG. 4. Alternatively, commercially available piezoelectric cable may be employed, such as Vibtek cable, manufactured by Raychem Corporation, United Kingdom, and marketed by Focal Ltd. Unit 4, Cheney Manor Industrial Estate, Swindon, SN2 2PJ, UK. Another commercially available piezoelectric cable is FPS-2 cable, available from G.T.E. Sylvania, POB 1488, Mountain View, Calif., 94042, USA. Alternatively, any other type of sensing cable, such as Guardwire cable, commercially available from Geoequipment Corporation, UK, may be used instead of piezoelectric cable.

Each piezoelectric cable segment 12 may be of any suitable length, such as between 5–30 cm, or between 15 and 25 cm. A sample length is 20 cm. The distance between adjacent piezoelectric cable segments 12 may be any suitable distance, such as between 50–300 cm, or between 100–250 cm. A sample length is 200 cm.

Most generally, the distance between adjacent piezoelectric cable segments depends on the sensing radius of the piezoelectric cable and may be determined experimentally. Preferably, the distance between adjacent first and second piezoelectric cable segments is selected such that the sensing radius of the first piezoelectric cable segment slightly overlaps the sensing radius of the second piezoelectric cable segment.

The intruder detection system of FIG. 1 also includes a fence 42 or other element to be monitored, along which is attached the sensing cable element 10 of FIG. 1. Cable element 10 may be attached to the fence 42 by any suitable means such as by means of conventional cable clamps 46.

The system of FIG. 1 typically also comprises a plurality of conventional field electric units 48 which are operative to process and decipher electric signals generated by the sensing cable element 10, and to report the deciphered signals to a central headquarters location (not shown).

Figure 2:
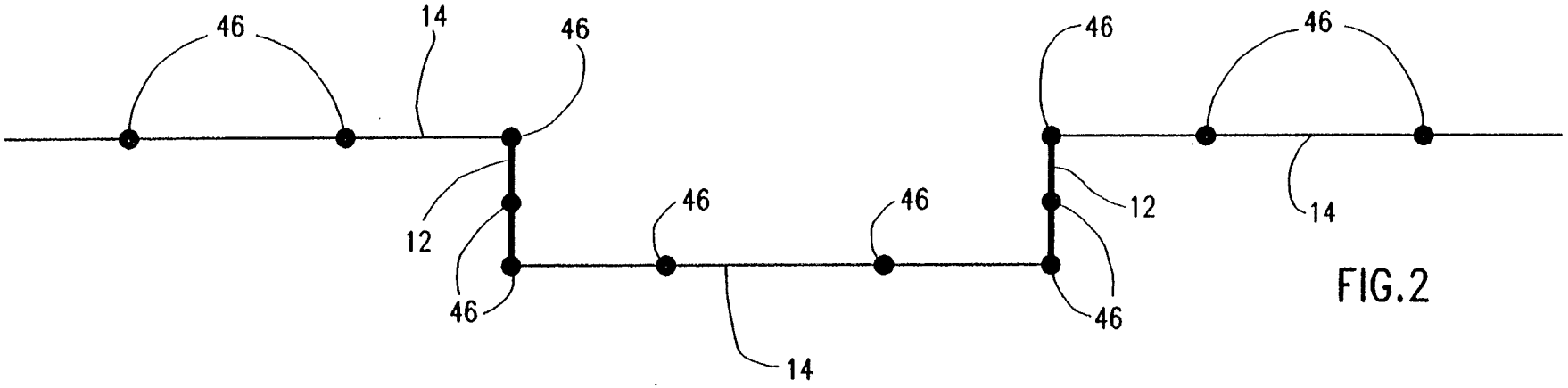
FIG. 2 is a schematic illustration of a preferred arrangement of the sensing cable element of FIG. 1 relative to an object to be monitored.
Figure 3:
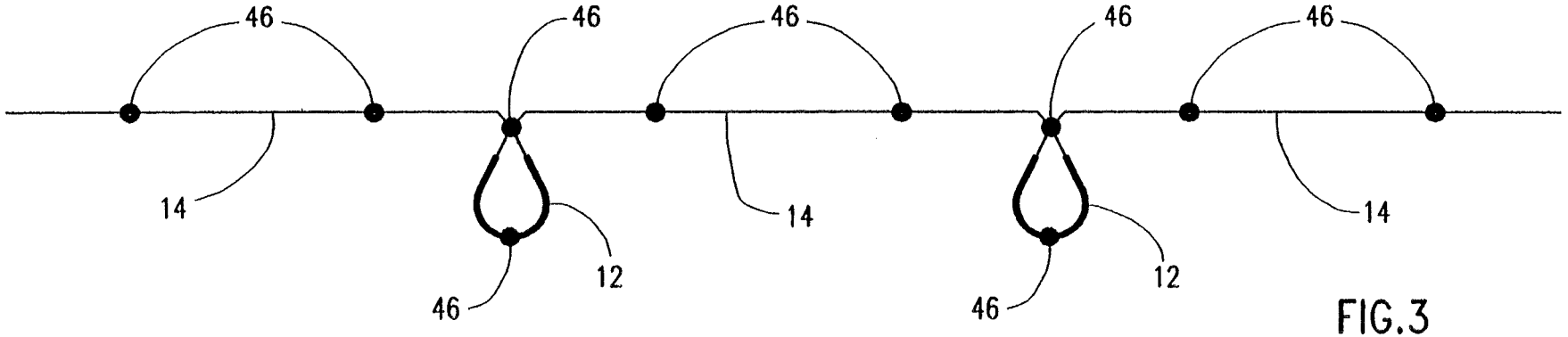
FIG. 3 is a schematic illustration of another preferred arrangement of the sensing cable element of FIG. 1 relative to an object to be monitored.

Reference is now made to FIGS. 2 and 3 which illustrate preferred arrangements of the sensing cable element 10 of FIG. 1. As shown, in both of FIGS. 2 and 3, the high detection capability portions 12 are arranged so as to be relatively inaccessible to precipitation, which is a common source of false alarms. In FIG. 2, the inaccessibility of high capability portions 12 is provided by orienting them generally vertically such that their horizontal surface area is very small. In FIG. 3, the inaccessibility of high capability portions 12 is provided by arranging them below adjacent low capability portions 14.

Preferably, each of the high capability portions 12 are disposed adjacent to at least one location at which the sensing cable element 10 is attached to the fence. According to one alternative embodiment of the invention, each high capability portion 12 may be centered about a clamp 46. This feature enhances the probability of detection by ensuring that all high capability portions are attached to the fence and therefore are capable of contributing significantly to detecting mechanical disturbances to the fence.

It is appreciated that, in order to securely attach the sensing cable element 10 to the fence, the number of attachment locations 46 may exceed the number of high capability portions required to "cover" the length of the fence, and therefore, high capability cable element portions may be associated with only some of the attachment locations 46.

Figure 4:
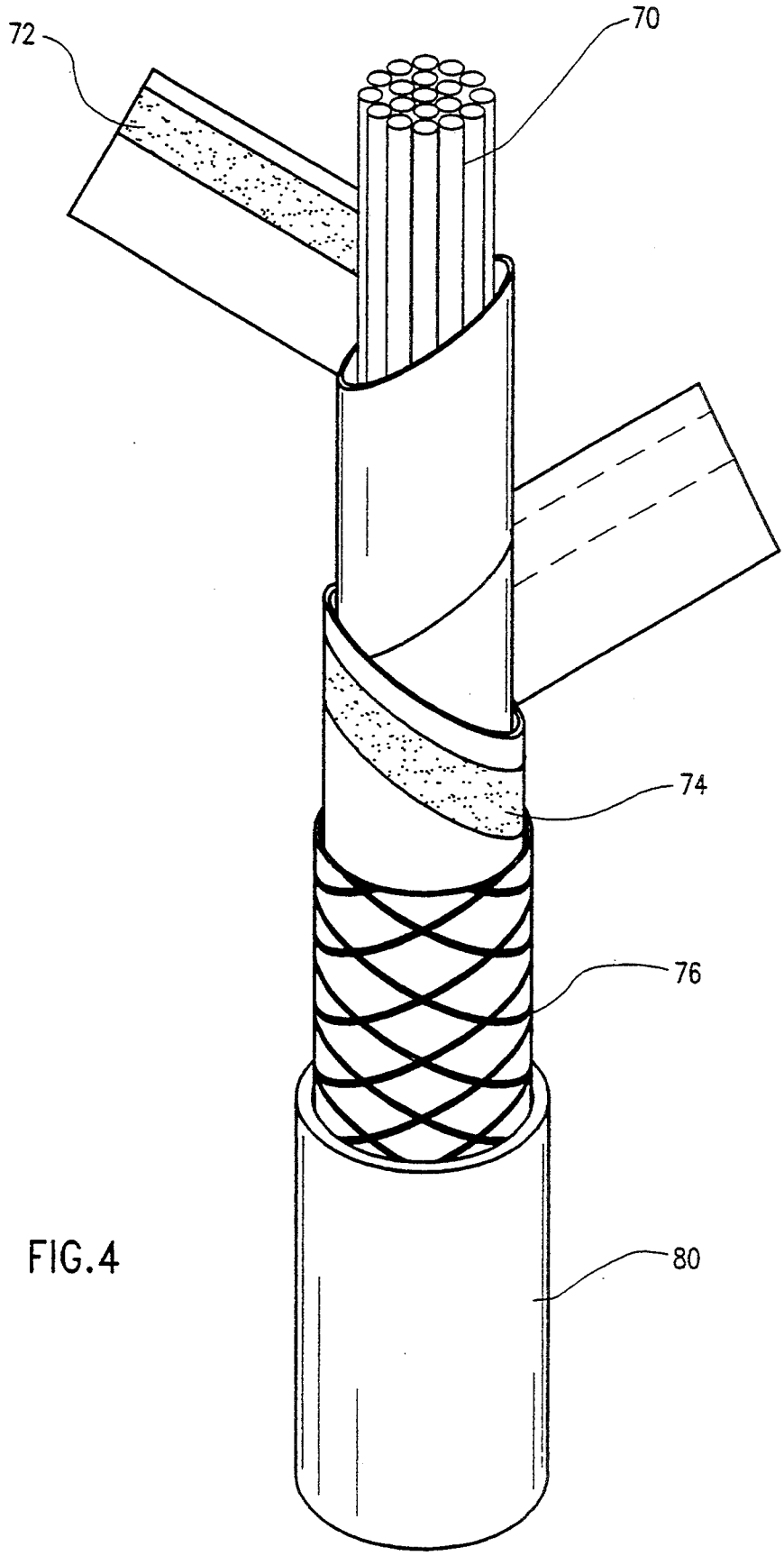
FIG. 4 is a perspective illustration of a piezoelectric cable segment.

Reference is now made to FIG. 4 which illustrates a segment of piezoelectric cable. As shown, the piezoelectric cable segment includes an inner conductor core 70, one or more piezoelectric bands such as a narrow piezoelectric band 72 and a broad piezoelectric band 74, a shield 76, such as a copper shield, and an outer cover 80 which may, for example, be formed of PVC (polyvinyl chloride). The piezoelectric band or bands may, for example, be formed of metallized PVDF (polyvinylidine fluoride).

Figure 5:
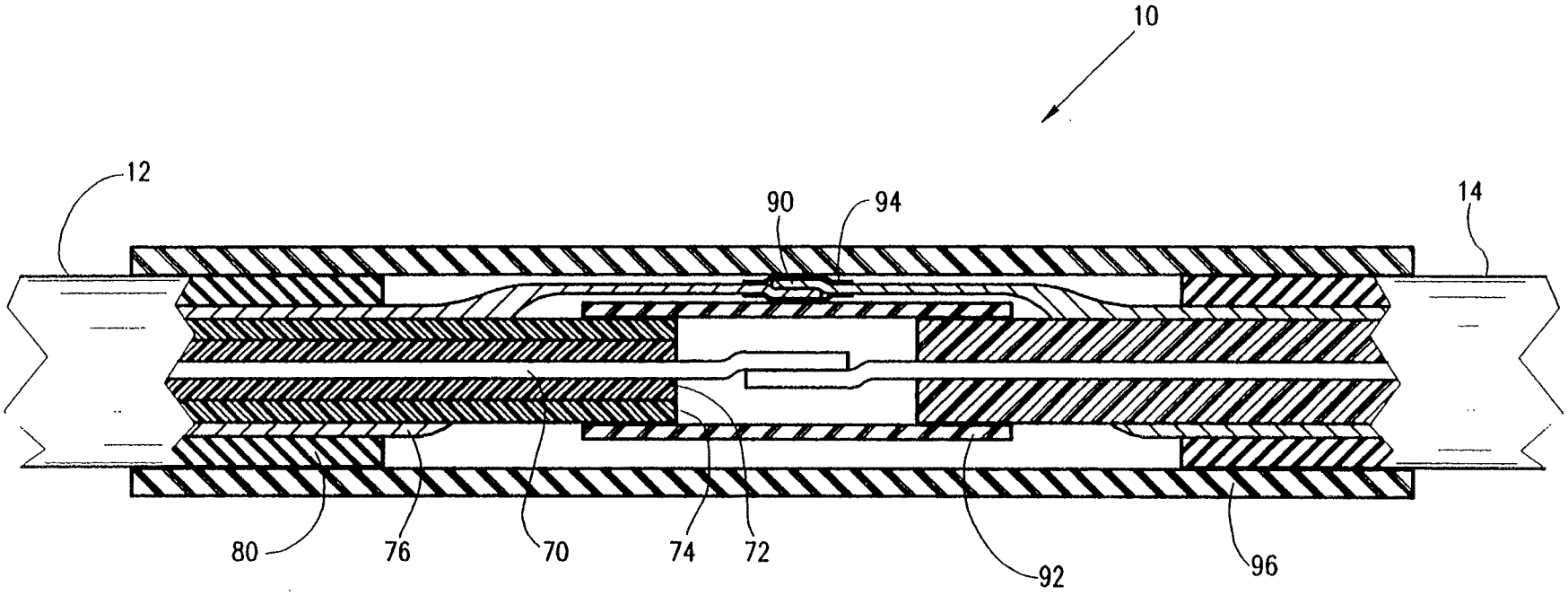
FIG. 5 is a cross-sectional view of a portion of the sensing cable element of FIG. 1.

An interconnection of a piezoelectric cable segment 12 and a neighboring coax cable segment 14 is illustrated in FIG. 5. A preferred method for joining a piezoelectric cable segment 12, such as that described above with reference to FIG. 4, to a neighboring coax cable segment 14 includes the following steps:

a. Remove the outer jacket 80 from the ends of the piezoelectric and coax cable segment which are to be attached. The coax cable segment may be configured similarly to the piezoelectric cable segment described above with reference to FIG. 4, except that the metallized PVDF layer is replaced by a layer of dielectric material.

b. Tear the shield 76 from the ends of both cable segments and form a tress 90 from the torn shield wires of the two cable segments.

c. Expose approximately 8 mm of the inner conductor 70 by stripping the PVDF layers in the piezoelectric cable segment and the dielectric layer in the coax cable segment.

d. Solder the two inner conductors and isolate with isolation tube 92.

e. Solder the two shields 76 and isolate with isolation tube 94.

f. Isolate the entire connection region with shrinkable tube 96.

The above method results, as shown in FIG. 5, in a mechanical disturbance sensing cable which varies "piecewise" along its length in its capability to detect mechanical disturbances. Specifically, the sensing cable shown and described above includes a plurality of segments which differ in their mechanical disturbance detecting capability. It is appreciated, however, that depending on the manufacturing process, the mechanical disturbance sensing cable need not vary piecewise along its length in its ability to detect mechanical disturbances. A suitable manufacturing process may be employed so as to provide a smoothly varying sensing cable element, such as the process of imputing mechanical disturbance detection capability to a cable element of generally uniform composition such that two or more levels of intensity or duration characterize the imputing process.

For example, the mechanical disturbance detection capability of piezoelectric cables such as Vibtek cables, manufactured by Raychem Corporation in the United Kingdom, is imputed by a polarization process. By varying the duration or intensity of polarization applied to different portions of a cable, variation in the mechanical disturbance detection capability therealong may be provided. Normally, this will result in sensing cable portions which are not discrete cable segments separated by distinct and well-defined boundaries, due to the fact that variance in the duration or intensity of polarization cannot be introduced instantaneously.

It will be appreciated by persons skilled in the art that the present invention is not limited to what has been particularly shown and described hereinabove. Rather, the scope of the present invention is defined only by the claims that follow:

We claim:

1. A sensing cable element comprising:

a non-uniform cable which is configured so as to substantially vary along its length in its ability to detect mechanical disturbances, wherein the non-uniform cable comprises a plurality of cable portions, wherein the mechanical disturbance detection capability of at least one of the plurality of cable portions is substantially greater than said capability in others of the plurality of cable portions.

2. A sensing cable element according to claim 1 wherein high mechanical disturbance detection capability cable portions are interspersed with low mechanical disturbance detection capability cable portions and wherein the distance between adjacent high mechanical disturbance detection capability cable portions does not exceed their respective sensing radii.

3. A sensing cable element according to claim 2 wherein the distance between adjacent high mechanical disturbance detection capability portions is less than their respective sensing radii.

4. A sensing cable element according to claim 1 wherein each cable portion comprises a cable segment and also comprising a plurality of segment couplers for coupling adjacent cable segments.

5. A sensing cable element according to claim 4 wherein each cable segment in each high mechanical disturbance detection capability cable portion is approximately 20 centimeters long.

6. A sensing cable element according to claim 4 wherein each cable segment in each low mechanical disturbance detection capability cable portion is approximately 2 meters long.

7. A sensing cable element according to claim 1 wherein the detection capability of the low mechanical disturbance detection capability portions is effectively zero.

8. A sensing cable element according to claim 1 wherein at least the high mechanical disturbance detection capability portions of the cable are formed of an individual one of the following:

piezoelectric cable;
magnetic cable; and
microphonic cable.

9. A sensing cable element according to claim 1 wherein the low mechanical disturbance detection capability portions of the cable comprise coax cable.

10. A sensing cable element according to claim 1 wherein each cable portion has an elongate configuration.

11. A sensing cable element according to claim 1 wherein each cable portion has a generally uniform cross-section.

12. A mechanical disturbance detection system comprising:

a non-uniform sensing cable which is configured so as to substantially vary along its length in its ability to detect mechanical disturbances; and at least one cable attacher for attaching the non-uniform sensing cable to an object to be monitored, wherein the non-uniform sensing cable comprises a plurality of cable portions, wherein the mechanical disturbance detection capability of at least one of the plurality of cable portions is substantially greater than said capability in others of the plurality of cable portions.

13. A system according to claim 12 and also comprising an object to be monitored to which the sensing cable is attached at a plurality of attachment locations.

14. A system according to claim 13 wherein the sensing cable is attached to the object to be monitored such that high mechanical disturbance detection capability portions of the sensing cable are generally inaccessible to precipitation.

15. A system according to claim 14 wherein the high detection capability portions are oriented substantially vertically.

16. A system according to claim 14 wherein the high detection capability portions are arranged generally below low mechanical disturbance detection capability portions of the sensing cable.

17. A system according to claim 13 wherein the sensing cable is attached to the object to be monitored such that at least one of the high mechanical disturbance detection capability portions are disposed adjacent a corresponding one of the plurality of attachment locations.

18. A system according to claim 17 wherein at least one of the high capability portions are centered about a corresponding one of the plurality of attachment locations.

19. A system according to claim 13 wherein the object to be monitored comprises a fence.

20. A system according to claim 12 wherein high mechanical disturbance detection capability cable portions are interspersed with low mechanical disturbance detection capability cable portions and wherein the distance between adjacent high mechanical disturbance detection capability cable portions does not exceed their respective sensing radii.

21. A system according to claim 20 wherein the distance between adjacent high mechanical disturbance detection capability portions is less than their respective sensing radii.

22. A system according to claim 12 wherein each cable portion comprises a cable segment and also comprising a plurality of segment couplers for coupling adjacent cable segments.

23. A system according to claim 22 wherein each cable segment in each high mechanical disturbance detection capability cable portion is approximately 20 centimeters long.

24. A system according to claim 22 wherein each each cable segment in each low mechanical disturbance detection capability cable portion is approximately 2 meters long.

25. A system according to claim 12 wherein the detection capability of the low mechanical disturbance detection capability portions is effectively zero.

26. A system according to claim 12 wherein at least the high mechanical disturbance detection capability portions of the sensing cable are formed of an individual one of the following:

piezoelectric cable;
magnetic cable; and
microphonic cable.

27. A system according to claim 12 wherein the low mechanical disturbance detection capability portions of the sensing cable comprise coax cable.

28. A method for manufacturing a mechanical disturbance detecting system comprising:

non-uniformly processing a sensing cable element such that the processed sensing cable element substantially varies along its length in its ability to detect mechanical disturbances, wherein the non-uniform sensing cable comprises a plurality of cable portions, wherein the mechanical disturbance detection capability of at least one of the plurality of cable portions is substantially greater than said capability in others of the plurality of cable portions.

29. A method according to claim 28 wherein the low mechanical disturbance detection capability portions of the sensing cable comprise coax cable.

30. A method according to claim 29 and also comprising the step of providing an object to be monitored to which the sensing cable element is attached at a plurality of attachment locations.

31. A method according to claim 30 and also comprising the step of attaching the sensing cable element to the object to be monitored such that high mechanical disturbance detection capability portions of the sensing cable element are generally inaccessible to precipitation.

32. A method according to claim 31 wherein the high detection capability portions are oriented substantially vertically.

33. A method according to claim 31 wherein the high detection capability portions are arranged generally below low mechanical disturbance detection capability portions of the Sensing cable element.

34. A method according to claim 30 wherein the sensing cable element is attached to the object to be monitored such that at least one of the high mechanical disturbance detection capability portions are disposed adjacent a corresponding one of the plurality of attachment locations.

35. A method according to claim 34 wherein at least one of the high mechanical disturbance detection capability portions are centered about a corresponding one of the plurality of attachment locations.

36. A method according to claim 30 wherein the object to be monitored comprises a fence.

37. A method according to claim 28 wherein high mechanical disturbance detection capability cable portions are interspersed with low mechanical disturbance detection capability cable portions and wherein the distance between adjacent high mechanical disturbance detection capability cable portions does not exceed their respective sensing radii.

38. A method according to claim 37 wherein the distance between adjacent high mechanical disturbance detection capability portions is less than their respective sensing radii.

39. A method according to claim 28 wherein each cable portion comprises a cable segment and also comprising the step of providing a plurality of segment couplers for coupling adjacent cable segments.

40. A method according to claim 39 wherein each cable segment in each high mechanical disturbance detection capability cable portion is approximately 20 centimeters long.

41. A method according to claim 39 wherein each each cable segment in each low mechanical disturbance detection capability cable portion is approximately 2 meters long.

42. A method according to claim 28 wherein the detection capability of the low mechanical disturbance detection capability portions is effectively zero.

43. A method according to claim 28 wherein at least the high mechanical disturbance detection capability portions of the sensing cable are formed of an individual one of the following:

piezoelectric cable;
magnetic cable; and
microphonic cable.

44. A method according to claim 29 and also comprising the step of attaching the processed sensing cable element to an object to be monitored.

45. A method for detecting mechanical disturbances comprising:

attaching a mechanical disturbance sensing cable element to an object to be monitored at a plurality of attachment locations; and employing the sensing cable element to provide warnings of mechanical disturbances, wherein the sensing cable element substantially varies along its length in its ability to detect mechanical disturbances, and wherein the non-uniform sensing cable comprises a plurality of cable portions, wherein the mechanical disturbance detection capability of at least one of the plurality of cable portions is substantially greater than said capability in others of the plurality of cable portions.

46. A method according to claim 45 wherein high mechanical disturbance detection capability cable portions are interspersed with low mechanical disturbance detection capability cable portions and wherein the distance between adjacent high mechanical disturbance detection capability cable portions does not exceed their respective sensing radii.

47. A method according to claim 46 wherein the distance between adjacent high mechanical disturbance detection capability portions is less than their respective sensing radii.

48. A method according to claim 45 wherein each cable portion comprises a cable segment and also comprising the step of providing a plurality of segment couplers for coupling adjacent cable segments.

49. A method according to claim 36 wherein each cable segment in each high mechanical disturbance detection capability cable portion is approximately 20 centimeters long.

50. A method according to claim 48 wherein each cable segment in each low mechanical disturbance detection capability cable portion is approximately 2 meters long.

51. A method according to claim 45 wherein the detection capability of the low capability cable portions is effectively zero.

52. A method according to claim 45 wherein at least the high mechanical disturbance detection capability portions of the sensing cable are formed of an individual one of the following:

piezoelectric cable;
magnetic cable; and
microphonic cable.

53. A method according to claim 45 wherein the low mechanical disturbance detection capability portions of the sensing cable comprise coax cable.

* * * * *